US006173546B1

(12) United States Patent
Schafer

(10) Patent No.: US 6,173,546 B1
(45) Date of Patent: Jan. 16, 2001

(54) INTERLOCKING METAL SHINGLE

(76) Inventor: James P Schafer, 7856 Wabash Ct., Englewood, CO (US) 80112

( * ) Notice: Under 35 U.S.C. 154(b), the term of this patent shall be extended for 0 days.

(21) Appl. No.: 09/143,311

(22) Filed: Aug. 28, 1998

Related U.S. Application Data

(60) Provisional application No. 60/057,188, filed on Aug. 29, 1997.

(51) Int. Cl.[7] ..... E04D 1/12

(52) U.S. Cl. ..... 52/522; 52/519; 52/520; 52/531; 52/554; 52/533

(58) Field of Search ..... 52/518, 519, 520, 52/522, 523, 525, 526, 529, 531, 539, 540, 528, 533, 554, 555

(56) References Cited

U.S. PATENT DOCUMENTS

| | | | |
|---|---|---|---|
| 345,089 | 7/1886 | Walter . | |
| 354,484 | 12/1886 | Patten . | |
| 358,595 | 3/1887 | Cortright . | |
| 359,958 | 3/1887 | Cortright et al. . | |
| 359,959 | 3/1887 | Cortright . | |
| 364,072 | 5/1887 | Wightman . | |
| 370,317 | 9/1887 | Cortright et al. . | |
| 397,381 | 2/1889 | Montross . | |
| 416,851 | 12/1889 | Norcross . | |
| 424,149 | 3/1890 | Toner et al. . | |
| 662,262 | 11/1900 | Galvin et al. . | |
| 832,003 | 9/1906 | Torrence . | |
| 889,818 | 6/1908 | Sherman et al. . | |
| 955,855 | 4/1910 | Day et al. . | |
| 1,597,993 | 8/1926 | Meurer . | |
| 1,743,206 | 1/1930 | Fulenwider et al. . | |
| 1,898,989 * | 2/1933 | Harshberger | 52/554 X |

(List continued on next page.)

OTHER PUBLICATIONS

Contractors Roofing and Building Insulation Guide, Rob Haddock, Metal Roofing: The Revolutionary Old Residential Alternative, Jul., 1993.

Vail Metal Systems, Technical Information booklet, available at least as early as Aug. 28, 1998.

Steel–Tite Roofing Systems Ltd., Castle Top Metal Shingles, Advertisement, available at least as early as Aug. 28, 1998.

Revere Copper Products, Inc., Revere Copper Products Bennington Shingles, Roofing That Reflects Your Style, Catalog, available at least as early as Aug. 28, 1998.

Springhouse Shingles Manufacturing Inc., We're Ready to Hang Out Our Shingle, Advertisement, available at least as early as Aug. 28, 1998.

SMACNA Architectural Manual—4th Ed., Plate 119, Flat Seam Roofs, available at least as early as Aug. 28, 1998.

Rheinzik Canada Ltd., Rauten Interlocking tiles "preweathered" DBP, available at least as early as Aug. 28, 1998.

The Peak of Performance, Classic Products Inc., Aluminum Roofing Installation Instructions, available at least as early as Aug. 28, 1998.

*Primary Examiner*—Carl D. Friedman
*Assistant Examiner*—Winnie Yip
(74) *Attorney, Agent, or Firm*—Dorsey & Whitney LLP

(57) ABSTRACT

A metal shingle including a main body having a top, bottom, left and right peripheral edges and a front and a back surface. The top edge defines a top flange bent over the front surface, and bottom edge defines a bottom flange bent over the back surface. The left edge is a straight edge, and the right edge is a lock-formed shape defining a channel. The metal shingle is attached to the underlying roof sheathing material either through a nailing flange or by a clip attached to the top flange. The metal shingle can be part of a shingle system. The metal shingle is relatively small in exposed area and easily interconnected with adjacent metal shingles.

4 Claims, 10 Drawing Sheets

U.S. PATENT DOCUMENTS

| | | | | |
|---|---|---|---|---|
| 2,173,774 | * | 9/1939 | Birch et al. | 52/522 |
| 2,188,454 | | 1/1940 | Braddock . | |
| 2,631,552 | | 3/1953 | Korter . | |
| 3,269,075 | | 8/1966 | Marini et al. . | |
| 3,347,001 | | 10/1967 | Cosden . | |
| 4,079,561 | | 3/1978 | Vallee . | |
| 4,671,037 | | 6/1987 | Bienvenu . | |
| 4,691,492 | | 9/1987 | Kane . | |
| 4,720,955 | | 1/1988 | Kane . | |
| 5,349,801 | * | 9/1994 | Verbofsky | 52/518 |
| 5,469,680 | | 11/1995 | Hunt . | |
| 5,613,337 | | 3/1997 | Plath et al. . | |

* cited by examiner

INTERLOCKING METAL SHINGLE

This appln claims the benefit of U.S. provisional application Ser. No. 60/057,188 filed Aug. 29, 1997.

FIELD OF THE INVENTION

This invention relates to roofing products, and more particularly relates to a new and improved metal shingle which allows convenient and weather-tight interconnectability and color blending.

BACKGROUND OF THE INVENTION

A great variety of different products are available for roofing materials, such as the traditional tar shingle, slate, tile, simulated wood products, and metal sheeting. Some of these products, such as typical tar shingles, have advantages over the other types of roofing material because they are less expensive and perform relatively well. Other types of roofing material, such as simulated wood roofing, slate, and tile, are more expensive, allow a different look to be applied to the roof of a house, yet sometimes suffer from poor performance since there are many seams and interconnection sites that must be weather-tight and are difficult to maintain. There has been an increased interest in metal roofing products which provide durable and weather-tight performance, in addition to having desirable appearance characteristics, in comparison to existing non-metal roofing products.

Metal roofing products have been available for quite some time, and provide a relatively reasonably priced roofing material with desired performance characteristics (resistance to hail damage, adequately weather-tight, and having a long life). Typically, the metal roofing products are available in long sheets either running continuously from the peak to the eaves of a roof, or running horizontally for several feet. These long sheets are sometimes formed to appear as if they are actually individual shingles, when in fact they are one piece of formed metal. One of the reasons elongated sheets have been popular is to reduce the number of seams and improve the weather-tight nature of the metal roofing material, and to make it more convenient to build and transport.

One significant drawback, however, is the fact that these long sheets of metal roofing material are difficult to ship without damage, and are expensive to form, especially if they have intricate artificial individual shingle folds formed therein.

One desirable aspect of tile and slate roofing, irrespective of high cost and maintenance, is that the different colors or hues of the material can be composed on a roof to create a very appealing appearance, which is the result of a process called blending. Blending is the intentional placement of individual or groups of shingles having different colors or hues next to each other to create the desired aesthetic effect—such as a weather-worn roof, a moss-laden roof, or simply a variety of different colors.

While the existing metal roofing has fewer seams to improve the weather-tight performance of the roofing material, the size of the sheets, which dictate the number of seams, are too large to allow effective blending of the roofing material. The large sheets of differing hues or colors placed next to each other do not create an appealing aesthetic appearance, and instead appear blocky or disjointed. The slate, tile and shake roofing materials that allow blending are much smaller in size and thus provide a more gradual transition between different hues and colors placed adjacent to one another. The slate and shake type roofing material that is formed of smaller individual units, however, have more seals to make weather-tight, and thus are less desirable. In some instances, an interleafing felt must be positioned underneath this roofing material to attempt to improve its weather-tight quality.

It is with the above issues in mind that the inventive metal single of the present invention was conceived and developed.

SUMMARY OF THE INVENTION

The present invention in general terms concerns a metal shingle roofing system made of individual metal shingles that are able to be interconnected together conveniently in a weather-tight manner, and have the desired exposed area to allow blending of various colors and hues for desired final appearance.

In more detail, the metal shingle includes a main body having a top, bottom, left and right peripheral edges and a front and a back surface. The top edge defines a top flange bent over the front surface, and bottom edge defines a bottom flange bent over the back surface. The left edge is a straight edge, and the right edge is a lock-formed shape defining a channel and a nailing flange.

The lock-formed edge includes a first section bending away from the front surface, a second section bending outwardly from the first section and extending parallel to the main body, a third section bending back under and adjacent to the second section, a fourth section bent in a U-shape to extend laterally outwardly from the main body and spaced away from the third section, defining a receiving channel.

In addition, a shingle system mounted on a roof sheathing material can incorporate the shingle of the present invention. The system includes a plurality of shingles, including a top adjacent, bottom adjacent, right adjacent and left adjacent shingles. Each of the shingles has a main body having a top, bottom, left and right peripheral edges and a front and a back surface. The top edge defines a top flange bent over the front surface, the bottom edge defines a bottom flange bent over the back surface, the left edge defines a straight edge, and the right edge has a lock-formed shape defining a channel and a nailing flange. The shingles are interconnected together to be weather-tight by the left edge of the right adjacent shingle being inserted into the channel of the right edge of the left adjacent shingle, and the bottom flange of the top adjacent shingle engaging the top flange of the bottom adjacent shingle.

In addition, a shingle mounting unit for attaching a shingle to a roof sheathing material can include a shingle of the present invention. The mounting unit includes a main shingle body having a top, bottom, left and right peripheral edges and a front and a back surface, the top edge defining a top flange bent over the front surface, the bottom edge defining a bottom flange bent over the back surface, the left edge being a straight edge, the right edge having a lock-formed shape defining a channel, and a clip for attaching to the top flange and securing the shingle to the roof sheathing material.

In more detail, the clip has a first base section, a second section sloping away from the first section, a third section extending from the second section and positioned substantially parallel to the first section, a fourth section extending from the third section and bending under the third section to form a U-shaped retainer, and a downwardly bent fifth section extending from the fourth section.

Accordingly, it is the primary object of the present invention to provide a metal shingle that is easily interconnectable with adjacent shingles, and also is of appropriate sizes to allow shingles of differing colors to be placed next to one another for the blending effect.

Other aspects, features and details of the present invention can be more completely understood by reference to the following detailed description of a preferred embodiment, in conjunction with the drawings, and from the appended claims.

DETAILED DESCRIPTION OF THE PREFERRED EMBODIMENT

Figure 1:
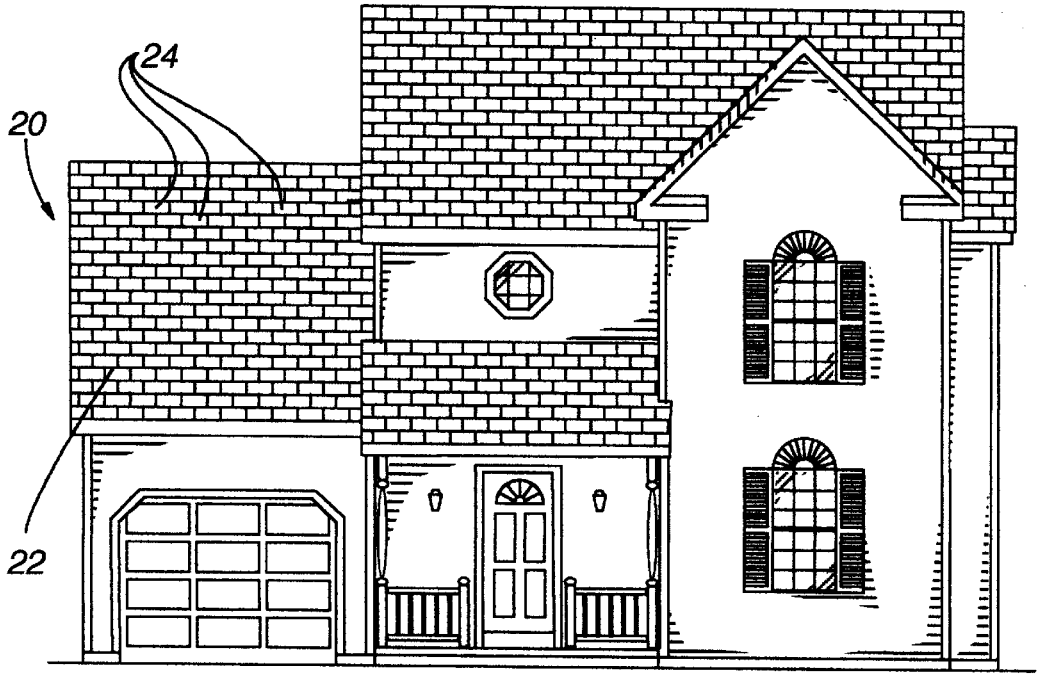
FIG. 1 is a front plan view of a house using the inventive roofing material of the present invention.

Referring first to FIG. 1, a house 20 having a roof 22 covered with the metal roofing material of the present invention is shown. The metal roofing material of the present invention is applied to the underlying sheathing of the roof 22 to provide a protective weather-tight seal on the roof. The metal roofing material of the present invention includes a plurality of individual metal shingles 24 having uniquely formed edges to provide complete connectability with the surrounding adjacent shingles in a weather-tight manner. The individual metal shingles 24 are of the size, or variety of sizes, that allow different colored shingles to be positioned adjacent to one another to create a blending effect not able to be obtained with metal roofing products having much large sheet sizes. The metal shingle 24 of the present invention thus combines blending capability with weather-tight interconnectability.

Figure 2:
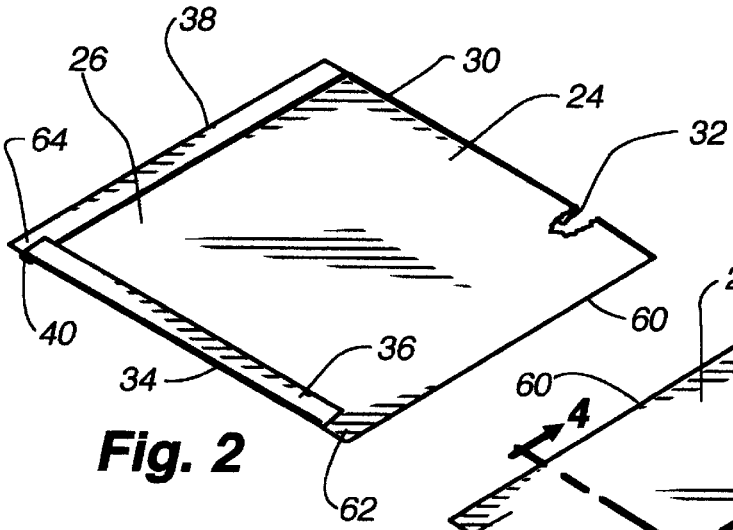
FIG. 2 is a perspective view of the back of one of the metal shingles of the present invention.
Figure 3:
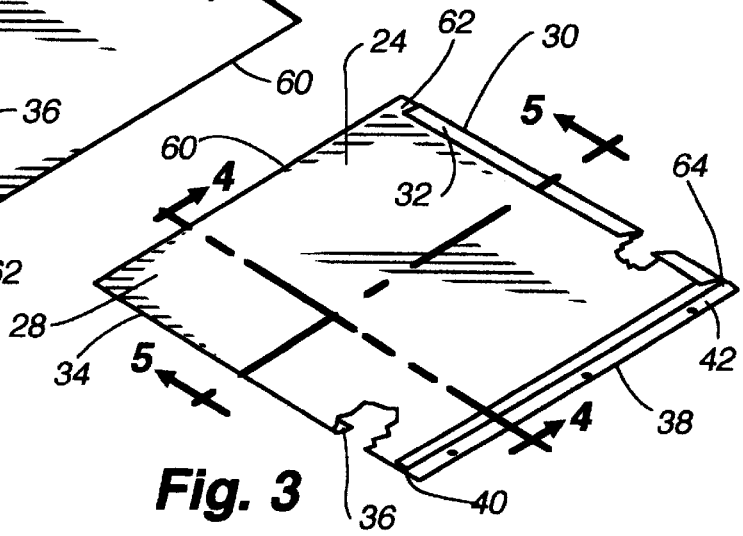
FIG. 3 is a perspective view of the outer surface or front of one of the metal shingles of the present invention.

Referring to FIGS. 2 and 3, each individual metal shingle 24 has a main body defining a back side 26 (FIG. 2) and a front 28 or outer side (FIG. 3). The main body can have a variety of shapes, but is preferably rectangular or square. The main body is made of sheet metal, preferably in the range of 0.0135 inches to 0.024 inches thick, and is preferably 0.017 inches thick.

The main body has four peripheral edges, each at a substantially 90° angle to the adjacent two sides. Each of the peripheral edges has a special shape and associated function for interconnection with the adjacent individual metal shingles. The top peripheral edge 30 (FIG. 3) defines a continuous flange 32 folding over the outer surface 28. The top flange 32 is preferably approximately ½ of an inch wide and is positioned at an acute angle to the outer surface. The top flange 32 is preferably between ¼ inches wide to ¾ inches wide, and extends at an angle of approximately 1° to 45°, preferably 22°, from the outer surface 28. The bottom peripheral edge 34 defines a continuous bottom flange 36 which bends over the back side. The bottom peripheral flange 36 is approximately ½ of an inch wide and is bent to an acute angle with the back surface of approximately 22°. The bottom flange is preferably between ¼ inches wide to ¾ inches wide, and extends at an angle of approximately 1° to 45°, preferably 22°, from the back surface 26.

Figure 4:
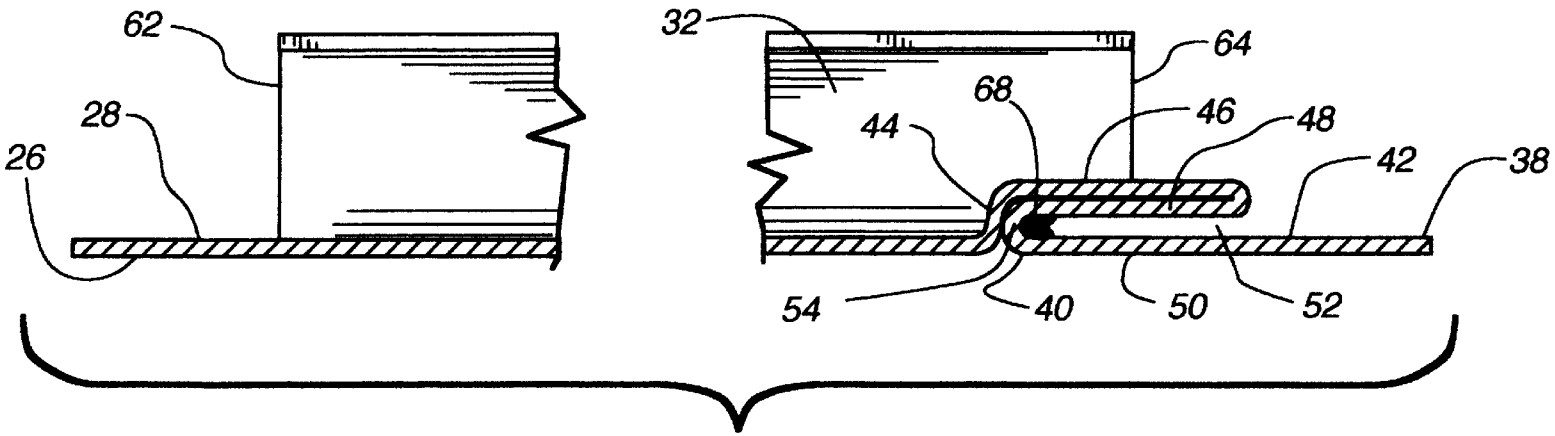
FIG. 4 is a section taken along the line of 4—4 of FIG. 3.
Figure 5:
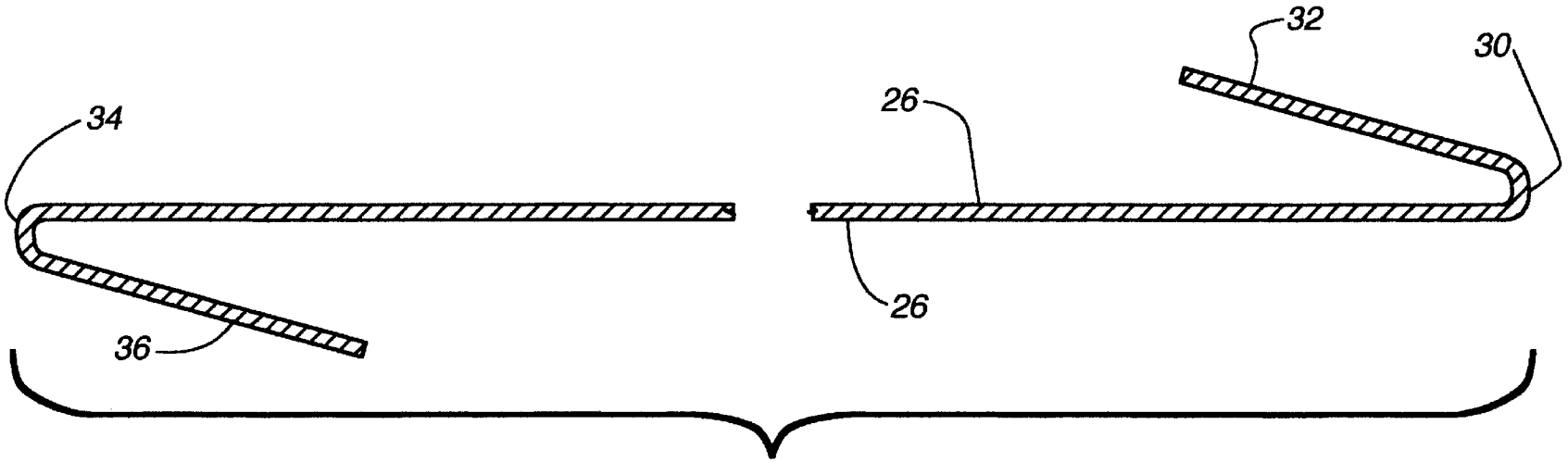
FIG. 5 is a section taken along the line of 5—5 of FIG. 3.

The right peripheral edge 38 (FIG. 3) defines a lock-formed shape 40 having a dual function of receiving an edge of an adjacent metal shingle, as described below, and forming a nailing flange 42 for securing the individual metal shingle to the roof sheathing. The right peripheral edge 38 of the present invention is shown best in FIGS. 3, 4 and 7. The lock-formed edge 40, such as shown in FIG. 4, is defined by a first section 44 bending from the front side 28 upwardly approximately three thicknesses of the metal, then a second section 46 bending outwardly from and parallel to the main body, then a third section 48 bending back under and adjacent to the second section 46, and finally a fourth section 50 bent in a U-shape to extend laterally outwardly from the main body and spaced away from the third section 48, to define a receiving channel 52. The receiving channel defines a base 54. The channel 52 of the lock-formed edge 40 is preferably between 3/16 to ½ inches deep, and preferably 5/16 inches deep.

The fourth section 50 of the lock-formed edge 40 extends beyond the third section 48 of the lock-formed edge and forms the nailing flange 42. The nailing flange 42 is preferably in the range of 5/16 to ½ inches wide, and is preferably ⅓ inches wide. The nailing flange 42 can have apertures 56 formed therein, preferably 3 inches apart, to facilitate placement of the fasteners 58, such as screws or nails, therethrough.

The top 32 and bottom 36 flanges terminate ¼ to ¾ inches short of the top and bottom ends of the right peripheral edge 38 (FIGS. 3 and 4), forming a notch 64, to allow the left peripheral edge of an adjacent shingle 24 to insert into the lock-formed edge 40 without interfering with the top 32 and bottom 36 flanges of the adjacent shingle.

The left peripheral edge 60 (FIG. 3) is a straight edge. The top 32 and bottom 36 flanges terminate 3/16 to ⅜ inches short of the top and bottom ends of the left peripheral edge 60 (FIGS. 3 and 4), forming a notch 62, to allow the left peripheral edge 60 of the shingle to insert into the lock-formed edge 40 of an adjacent shingle without interfering with the top 32 and bottom 36 flanges of the adjacent shingle.

These top 32 and bottom 36 flanges allow the adjacent side-to-side shingles to be accurately attached and interconnected without the top and bottom flanges interfering with one another. This makes them able to be aligned with one another (top to bottom) continuously during application since the position of the left edge 60 of one shingle can be adjusted along the channel 52 of the right edge 38 of the adjacent shingle. The adjustability is an important factor that allows the shingles to be positioned on an imperfect roof sheathing substrate. If the right and left notches were non-existent, each shingle would have to be offset upwardly or downwardly with respect to one another to facilitate the side-to-side interconnection. In addition, the lock-formed edge would be more difficult to form if the top and bottom flanges were formed first. Also, the lock-formed edge would interfere with the formation of the top and bottom flanges if the lock-formed edge was formed first.

Figure 6:
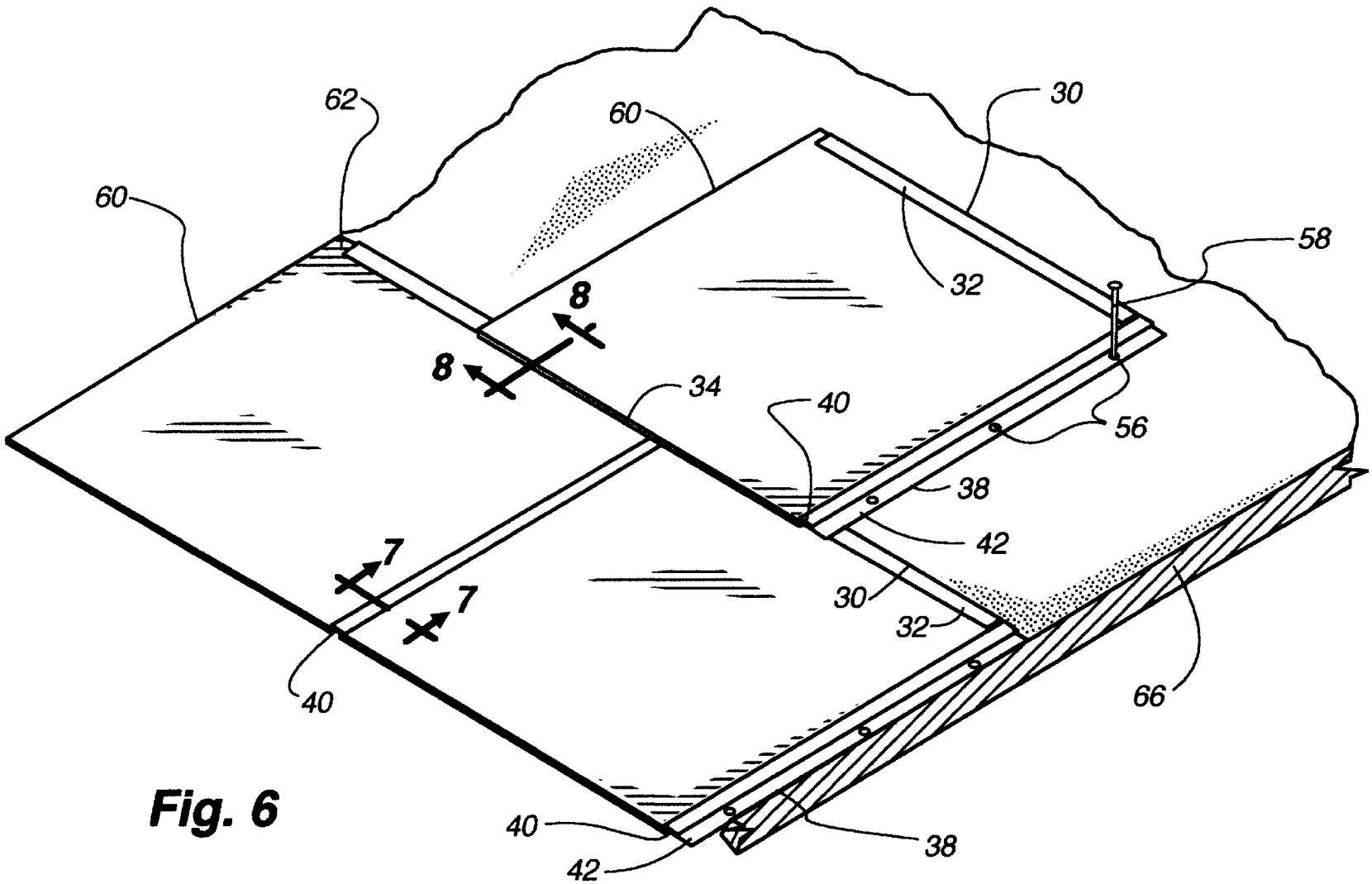
FIG. 6 is a perspective view of a plurality of the individual metal shingles of the present invention assembled together.
Figure 7:
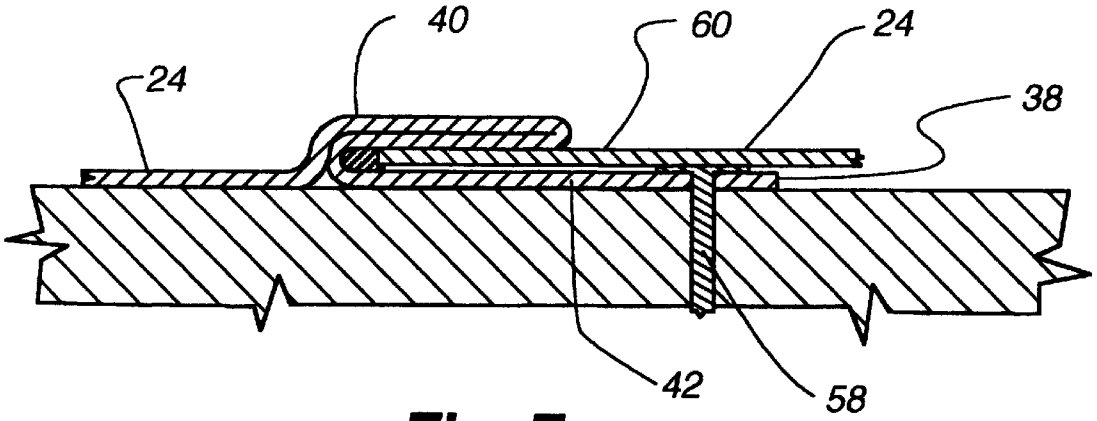
FIG. 7 is a section taken along the line of 7—7 of FIG. 5.
Figure 8:
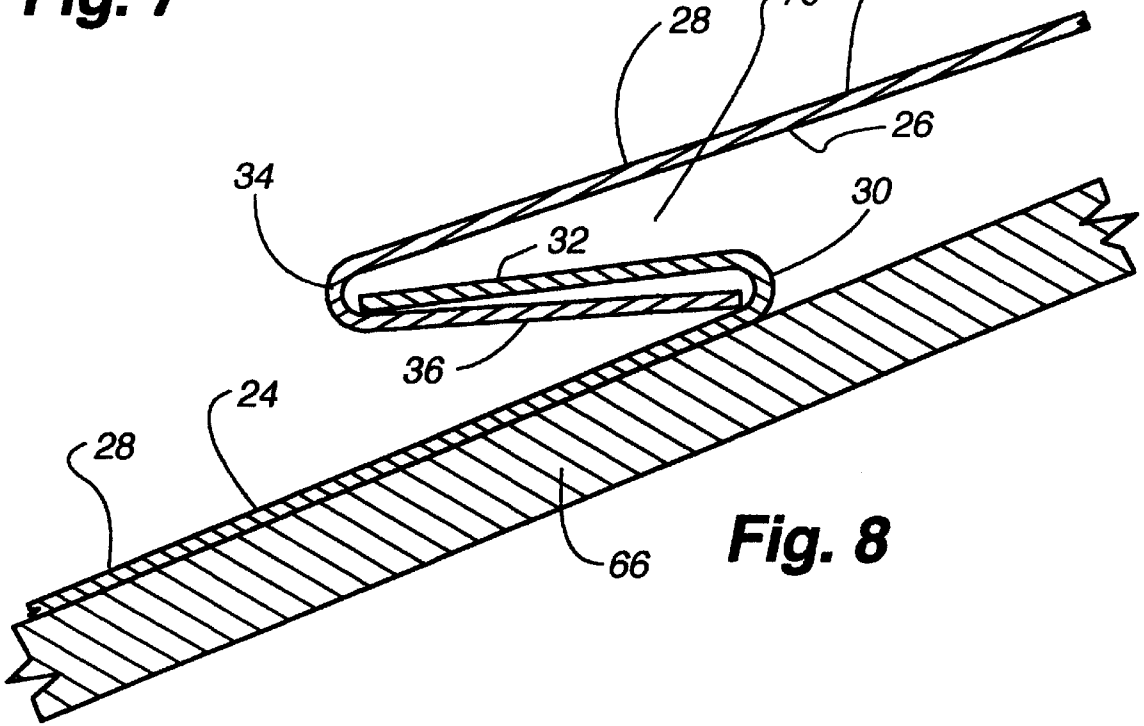
FIG. 8 is a section taken along the line of 8—8 of FIG. 5.

The particular shapes of the peripheral edges allow the individual metal shingles to be interconnected with adjacent metal shingles in a secure and weather-tight manner. As shown in FIGS. 6, 7 and 8, a plurality of individual metal shingles 24 are interconnected together and fastened to the underlying roofing sheath 66. The bottom peripheral flange 36 of a first shingle is interlocked with the top peripheral flange 32 of a second shingle to interconnect the two shingles together in a weather-tight manner. The angles at which these flanges are oppositely bent, and the width of the flange, is important because if the angle is not sufficiently acute, the interaction between the bottom 36 and top 32 peripheral flanges will not be sufficiently resistant to wind-uplift. If the flange width is not sufficient, then not enough material overlap is present to resist wind-uplift. In addition, the angle at which the flanges are bent affects the appearance of the shingles on the roof as a more acute angle reduces shadow-lines, a more obtuse angle increases shadow lines. The interaction of the bottom peripheral flange and the upper peripheral flange of a sample interconnection of two metal shingles is shown in FIG. 8.

The right peripheral edge 38 is attached to the underlying roof sheathing by a fastener 58, such as a screw or a nail. Again, the screw or nail can be positioned through pre-formed apertures 56 in the nailing flange 42 if desired. Preferably two fasteners should be used along each nailing flange 42. The head of the fastener is preferably made flush with or below the nailing flange so as to not interfere with the performance of the lock-formed edge 40. The left peripheral straight edge 60 is inserted into the channel 52 formed in the lock-formed edge 40 of an adjacent shingle, and over the fasteners 58 holding the nailing flange 42 to the underlying roof sheathing 66. Thus, the left peripheral edge 60 contacts or is adjacent to the base 54 of the channel 52. This interconnection forms a weather-tight seal between left and right adjacent shingles, as shown in FIG. 7.

An improved weather-tight seal is formed between left and right adjacent metal shingles by the insertion of a sealing material 68, or equivalent, such as silicon caulk or butyl, at the base 54 of the channel 52 prior to insertion of the left straight edge 60. This allows the left peripheral edge 60 to contact and seat into the silicon caulk material in the base of the channel when the left peripheral edge 60 is inserted into the channel of the lock-formed edge 40 (FIG. 7). The caulk enhances the weather-tight connection between the left and right adjacent metal shingles.

In this manner all of the edges of the each metal shingle are attached in a weather-tight interlocking manner to adjacent metal shingles to form a continuous weather-tight protective roofing layer over the roof sheathing material 66, and provide the traditional benefits expected of metal roofing. The individual metal shingles 24 of the present invention are manufactured easily on standard metal forming equipment, and can be made out of precolored sheet steel, or galvanized metal, copper or aluminum sheet material. The individual shingles can be embossed to provide surface texturing and additional blending capability.

When the metal shingles 24 are interconnected, the next higher adjacent row of shingles is desirably positioned to overlap the side-seams between left and right adjacent shingles in the lower row, as shown in FIG. 6. This relative positioning helps improve and maintain the weather-tight characteristics of the system of interlocked shingles. Also, the void 70 formed between the lower edge of the upper adjacent shingle and the roof sheathing material helps promote and allow airflow and ventilation underneath each row of metal shingles. This feature facilitates the evaporation of any moisture that does penetrate through the interconnected shingle system, or condenses under the shingle system from moist air passing through the roof sheathing 66 from below.

The shingles can be applied in lateral rows, or in a vertical diamond shape with the same weather-tight effectiveness and convenient alignment capabilities.

The individual metal shingle 24, when interconnected on all sides with adjacent metal shingles, defines an exposed outer surface. The exposed area is the net area of the shingle that is not covered by adjacent shingles to which it is interconnected. The exposed outer surface is preferably no larger than approximately four square feet in area, and is preferably approximately 0.9 to 2.0 square feet in area.

Important aspects of the present invention include the relatively small size of the individual metal shingles 24 in combination with the structure on the peripheral edges which allow the individual metal shingles 24 to be interconnected with adjacent individual metal shingles in a weather-tight manner to form a roofing system. The interconnecting structure of the lateral edges on the individual metal shingles allow simple application of the metal roofing material to the roof sheathing as well as provide weather-tight seams between adjacent individual metal shingles.

While the particular connection structure formed on each of the lateral edges of an individual metal shingle are able to be used on very large scale individual metal shingles, such as greater than four square feet of exposed surface area, one of the other benefits of the present invention is that the size of the metal shingles are relatively small to allow for the desirable effect of blending the individual metal shingles upon application to a roof sheathing base 66. In addition, other benefits include the significant reduction in waste due to penetrations of the roof (chimneys or the like), valleys, hips and ridges. These features require that the roofing material be modified to properly fit, and where larger metal shingles are used, more waste is generated.

An alternative embodiment of the metal shingle 80 is shown in FIGS. 10–14. The top 82, bottom 84, left 88 and right 86 side edges are formed similarly to that described above with respect to the first embodiment. Adjacent shingles are interconnected together in a fashion similar to that described above with respect to the first embodiment. The alternative embodiment of the metal shingle 80 of the present invention is fastened to the roof sheathing in a different manner. The alternative embodiment uses a clip 90 mounted along the top edge 82 of the shingle 80 and fastened to the roof sheathing 92, as described below, instead of fasteners positioned through the nailing flange.

Figure 10:
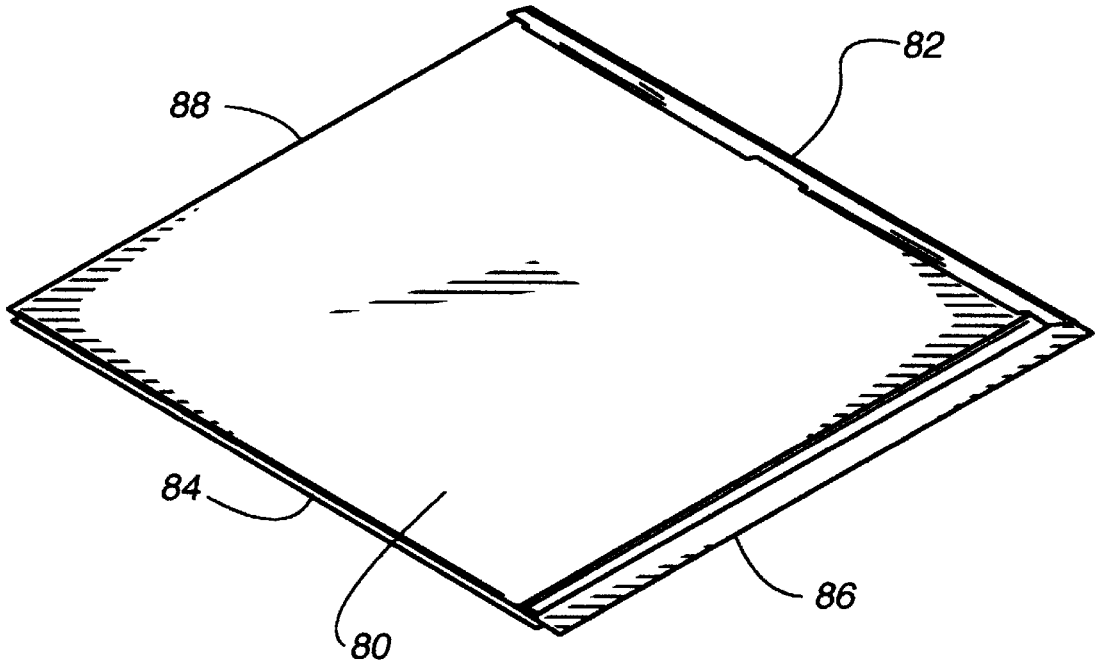
FIG. 10 is a perspective view of the back of an alternative embodiment of one of the metal shingles of the present invention.
Figure 11:
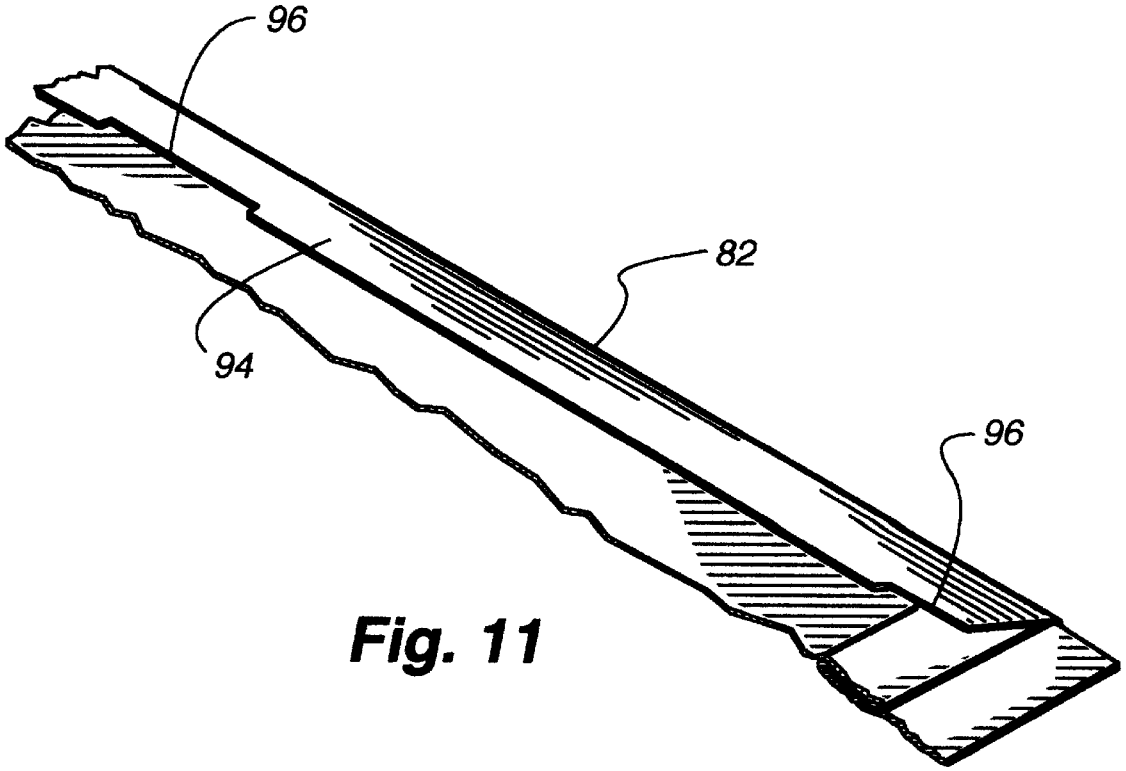
FIG. 11 is an enlarged partial view of the top edge of the alternative embodiment of the metal shingle of the present invention.
Figure 12A:
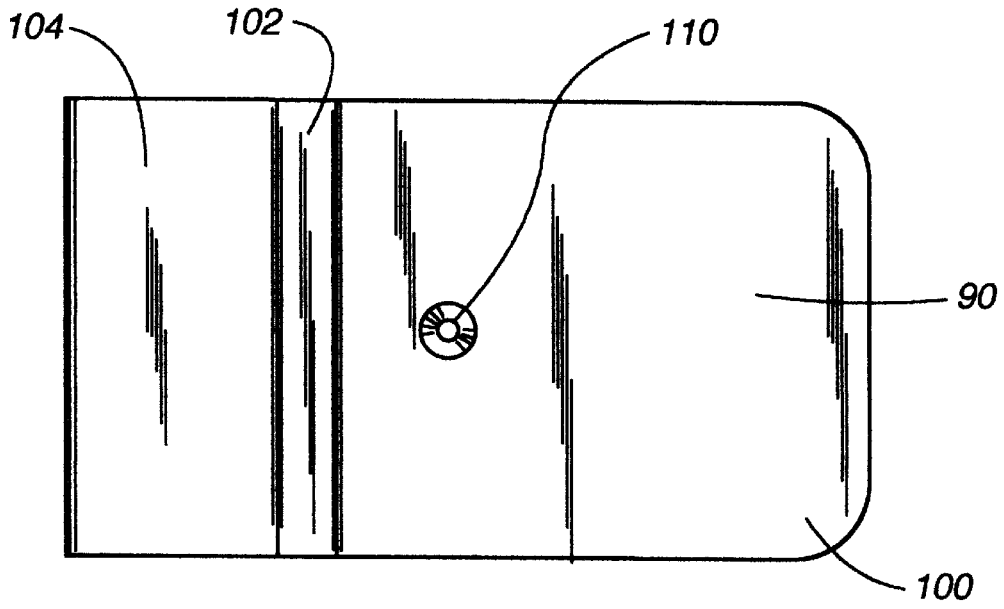
FIGS. 12*a, b* and *c* are various views of the clip used with the alternative embodiment of the present invention.
Figure 12B:
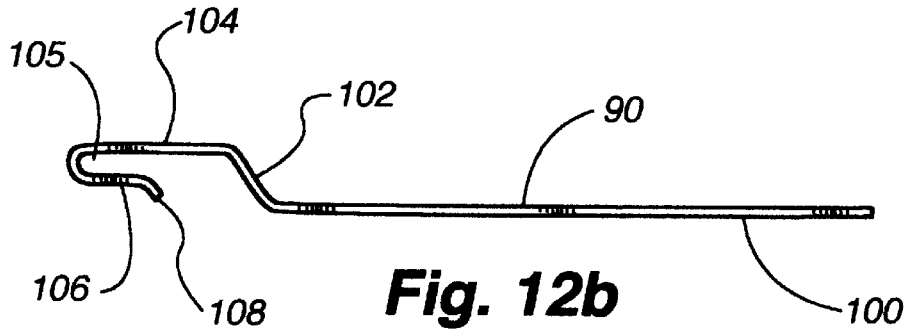
Figure 12C:
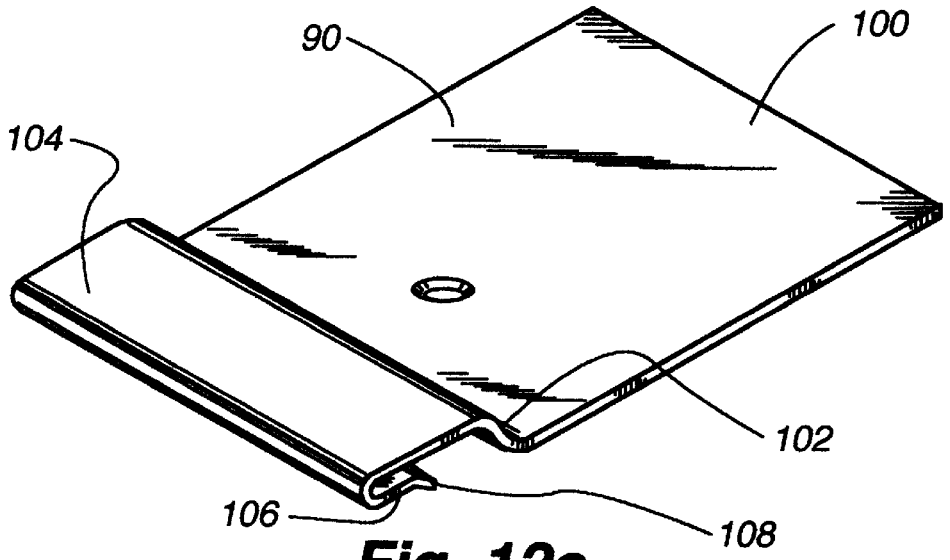
Figure 13:
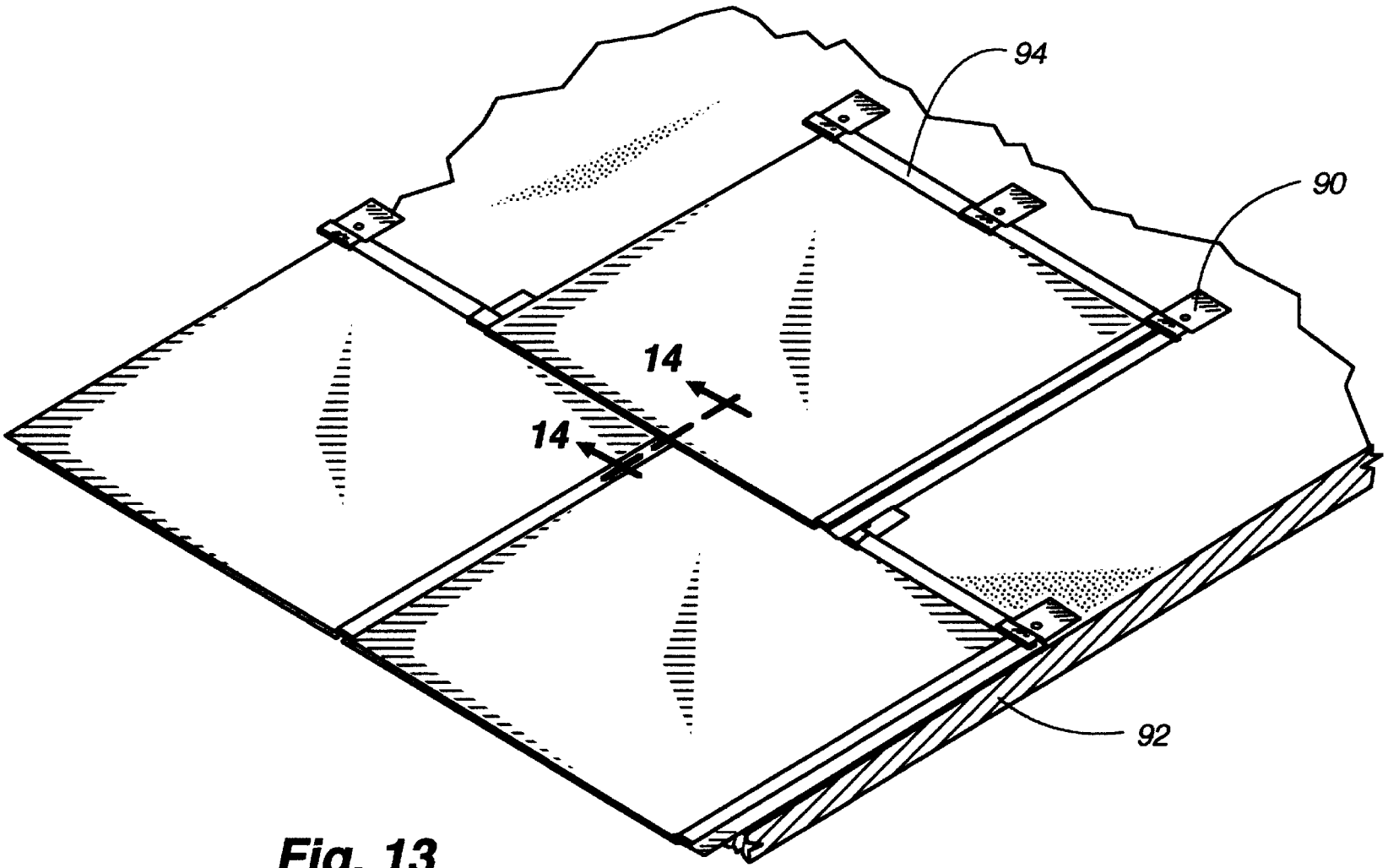
FIG. 13 is a view of a plurality of the alternative embodiments of the present invention attached with the clips.
Figure 14:
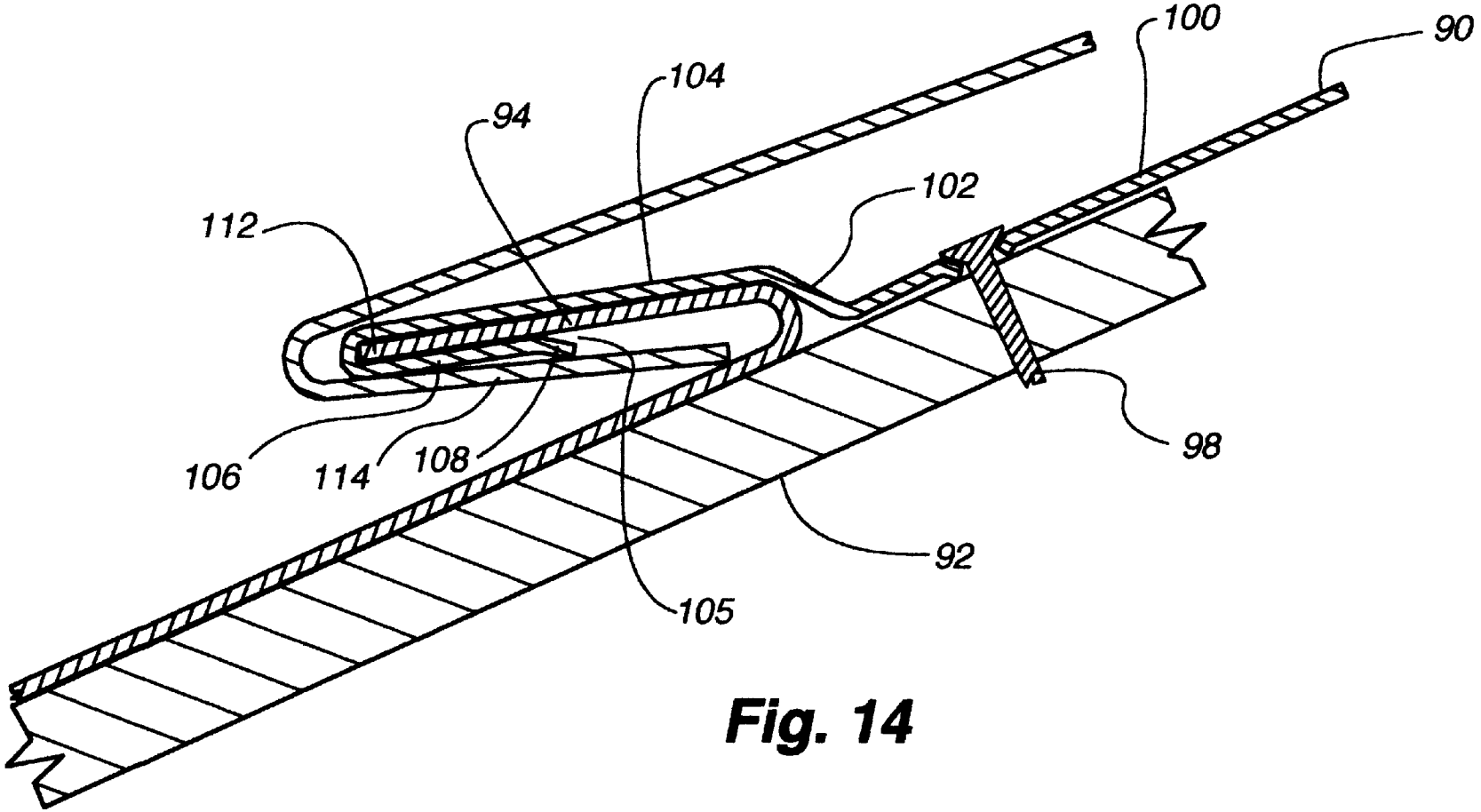
FIG. 14 is a section taken along line 14—14 of the present invention.

The clips 90, shown in FIGS. 12*a, b,* and *c,* are positioned along the top flange 94 of the shingle 80 as shown in FIG. 14. The clips 90 are each positioned in a clip notch 96 formed on the edge of the top flange 94. The clip notches 96 are approximately 1/16 of an inch deep, and sufficiently wide to receive the clip. The clip notch 96 is deep enough so that when the clip 90 is positioned in the clip notch 96, the top surface of the clip 90 is flush with the edge of the top flange 94. Preferably, one full notch 96 is formed in the middle of the top flange 94 (from side to side), and one-half of a notch is formed at each end of the top flange 94, as shown in FIG. 10, and detailed in FIG. 11. The positioning of the clip 90 in the notches 96 is shown in FIG. 13, with each clip 90 on the ends of the top flange 94 engaging the top flange of both adjacent shingles. This helps keep the adjacent shingles in alignment with each other top-to-bottom and side-to-side. Each clip 90 is fastened to the roof sheathing 92 by a fastener, such as a nail, screw or other similar attachment means.

Details of the clip are shown in FIGS. 12*a, b* and *c*. Each clip has a first base section 100, an upwardly sloping second section 102, a third section 104 substantially parallel to the first section 100, a fourth section 106 bending under the third section to form a U-shaped retainer 105, and downwardly bent fifth section 108. An aperture 110 is formed in the first base section to receive a fastener 98. The clip 90 is preferably in the range of 1 to 1 and ½ inches wide, and is preferably 1 and ⅜ inches wide. The U-shaped retainer is preferably in the range of ¼ to ½ inches deep, and preferably approximately ⅜ inches deep, and $1/16^{th}$ of an inch wide. The clip 90 can be made of metal or plastic.

The attachment of the clip 90 is shown in detail in FIG. 14. The edge of the top flange 94 is received in the U-shaped retainer 105, and the third section 104 of the clip extends along the top flange 94, preferably in contact therewith. The first base section 100 is then fastened to the roof sheathing 92, thus securing the shingle to the roof The edge 112 of the top flange 94 is sufficiently seated in the clip 90, by approximately one-half of the flange 94 width, to help keep the flange from becoming unseated from the clip 90. The clip 90, fastened to the roof sheathing, helps secure the shingle to the roof with a strength sufficient to resist wind-uplift. The bottom flange 114 of the adjacent upper shingle extends over and hooks around the clip 90 and the top flange 94 of the adjacent bottom shingle. The clip 90 is thus covered by the adjacent upper shingle.

The shingle of the present invention can thus be attached to the rood sheathing by various attachment means, preferably the fasteners positioned through the nail flange or fasteners positioned through the clip.

Blending is the application of differently colored metal shingles adjacent to one another to provide the desired appearance of the end product. For blending to result in an acceptable appearance, the individual metal shingles should be less than approximately four square feet in exposed area. Where the exposed area of an individual shingle is too large, for instance greater than 4 square feet, blending is not feasible because the contrasting colors on the large shingles positioned next to each other look too blocky and unintegrated. On large sized singles with large exposed areas, the colors are not able to blend together along nondescript lines, but instead are highly contrasted along geometrical lines (depending on the shape of the individual shingle). The final effect of the shingles when mounted on the roof is then disjointed and unappealing.

Figure 15:
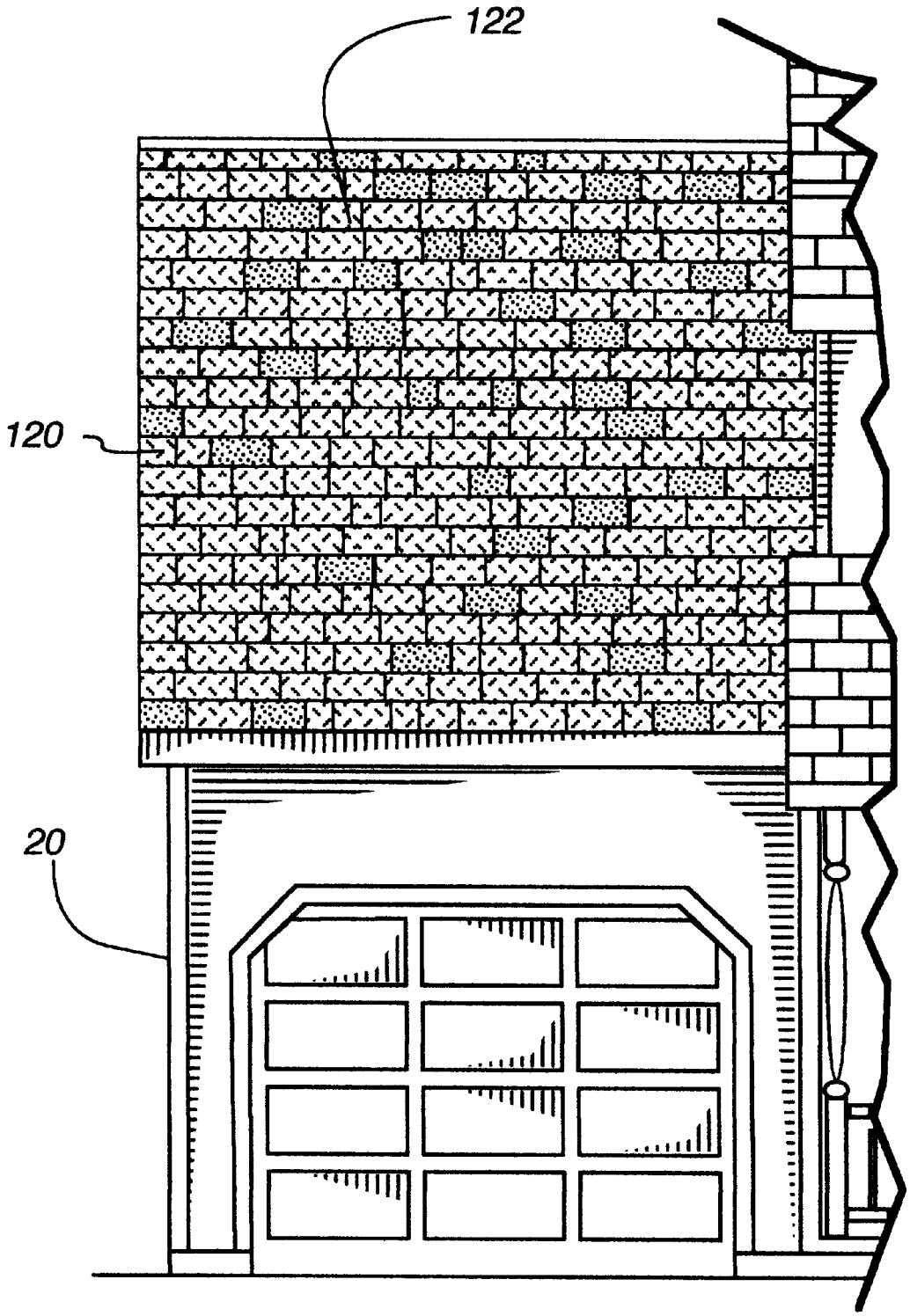
FIG. 15 is a partial view of the metal roofing material of the present invention applied to the roof of a house utilizing the blending capability of the differently-sized individual metal shingles.

With the relatively smaller and irregular width shingle size, of less than approximately 4 square feet, the line of contrast between different colors can be made less geometrical and more non-descript because of the small scale displacement allowed in the application of the individual shingles. Such an effect is shown with the shingle of FIGS. 9 and 15. The blending characteristic is basically based on the size of the exposed area of the individual shingles, and is only practical in a metal roofing system where the individual shingles have a relatively small exposed area and interconnect conveniently and securely with adjacent shingles to form a weather-tight and economical roofing system. As an addition, a felt underlayment may be positioned under the metal shingle roofing system of the present invention to enhance the weather-tight performance.

Figure 9:
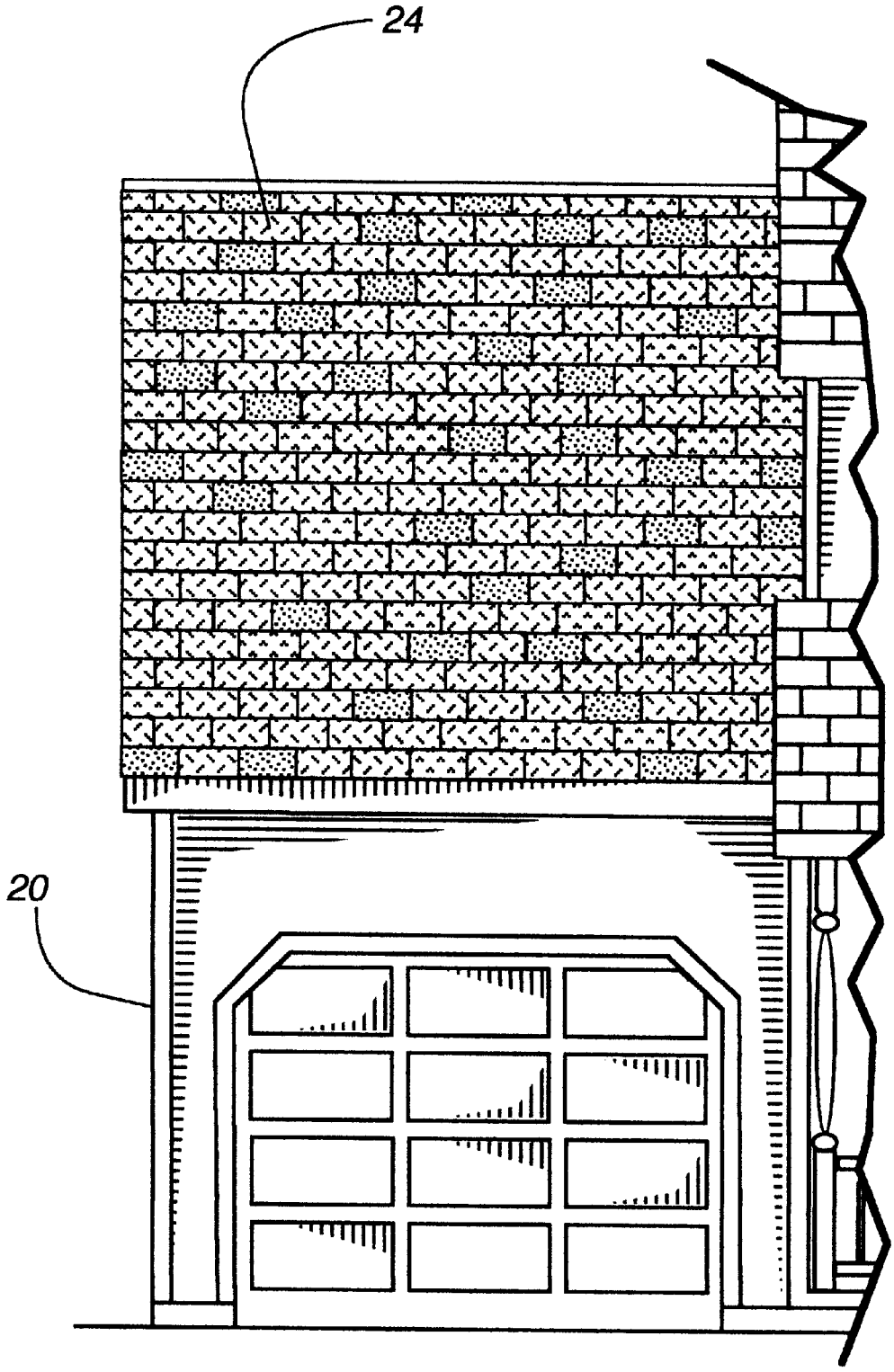
FIG. 9 is a partial view of the metal roofing material of the present invention applied to the roof of a house utilizing the blending capability of the individual metal shingles.

The use of differently-sized metal shingles of the present invention helps create blendability and still allow offset keyways for maximum water shedding capabilities. A keyway is the side-lap of two adjacent shingles. If one keyway is directly above another keyway, then there is more potential for a leak to occur between shingles. The differently-sized metal shingles also blend colors together less noticeably than using the same sized shingles. The shingles in FIG. 9 are identical in size, and the shingles in FIG. 15 include shingles 120 having ½ the length of the largest shingle, and shingle 124 having ¾ the length of the largest shingle. The height of the shingles are the same to facilitate their alignment along a row. The use of ½ and ¾ width shingles allow the blending of colors to be more subtle. Narrower width shingles can be added to also provide a more shake-like appearance.

In blending the different colors of the shingles on a roof, where there are two colors, preferably 70 percent of the shingles are one color, and approximately 30 percent of the shingles are the other color. Where there are three colors, preferably 70 percent of the shingles are the first color, approximately 25 percent of the shingles are the second color, and approximately 5 percent of the shingles are the third color. This scenario is shown in FIG. 9. Where there are four colors, approximately 80 percent of the shingles are the first color, approximately 8 percent of the shingles are the second color, approximately 8 percent of the shingles are the third color, and approximately 4 percent of the shingles are the fourth color. The shingles are positioned randomly with respect to one another to minimize the grouping of the second (or more) colors. These guidelines help assure a roof design that is aesthetically pleasing. Where the shingles have a textured surface, the blending effect is enhanced.

The metal shingles of the present invention allow weather-tight interconnectability due to their unique edge structures, and because of the relatively small exposed area, are conducive to successful blending when applied to the roof sheathing.

Presently preferred embodiments of the present invention and many of its improvements have been described with a degree of particularity. The previous description is of a preferred example for implementing the invention, and the scope of the invention should not necessarily be limited by this description. The scope of the present invention is defined by the scope of the following claims.

I claim:

1. A shingle for connecting with an adjacent shingle on a roof, said shingle comprising:

a main body having a top, bottom, left and right peripheral edges and a front and a back surface;

said top edge defining a flange bent over said front surface;

said bottom edge defining a flange bent over said back surface;

said right edge having an interlocking flange, said interlocking flange including a first section bending away from the front surface, a second section bending outwardly from said first section and extending parallel to the main body, a third section bending back under and adjacent to the second section, and a fourth section bent in a U-shape to extend laterally outwardly from the main body and spaced away from the third section, said fourth section defining a receiving channel for receiving the left edge of the adjacent shingle, said fourth section flatly laying in a same plane with said front surface; and wherein when the adjacent shingle engages said right edge, the layers of the shingles along the engagement form continuous contacting layers resting on the roof to resist crushing.

2. The shingle as defined in claim 1, wherein:

said receiving channel defines a base; and a sealing material is positioned in the base.

3. A shingle system mounted on a roof sheathing material, said system comprising:

a plurality of shingles, including a top adjacent, bottom adjacent, right adjacent and left adjacent shingles, each having:

a main body having a top, bottom, left and right peripheral edges and a front and a back surface;

said top edge defining a top flange bent over said front surface;

said bottom edge defining a bottom flange bent over said back surface;

said left edge defining a straight edge;

said right edge having an interlocking flange, said interlocking flange including a first section bending away from the front surface, a second section bending outwardly from said first section and extending parallel to the main body, a third section bending back under and adjacent to the second section, and a fourth section bent in a U-shape to extend laterally outwardly from the main body and spaced away from the third section, said fourth section defining a receiving channel to receive the left edge of the right adjacent shingle, said fourth section flatly laying in a same lane with said front surface; and said plurality of shingles Interconnected together to be weather-tight by said left edge of said right adjacent shingle engaging said interlocking flange of said left adjacent shingle, with the layers of the shingles along the engagement form continuous contacting layers resting on the roof to resist crushing; and said bottom flange of said top adjacent shingle engaging said top flange of said bottom adjacent shingle.

4. A shingle system as defined in claim 3, wherein:

said receiving channel defines a base; and a sealing material is positioned in the base.

* * * * *